United States Patent [19]

Mancini

[11] Patent Number: 4,923,355

[45] Date of Patent: May 8, 1990

[54] SYSTEM TO FEED AND DISCHARGE MATERIALS CONTINUOUSLY IN OPERATIONS TO REHABILITATE RAILWAY ROAD BEDS AND THE LIKE

[75] Inventor: Flavio Mancini, Brescia, Italy

[73] Assignee: ITI/CLM Impianti Tecnici Industriali Danieli & C. Officine Meccaniche SpA, Buttrio, Italy

[21] Appl. No.: 217,968

[22] Filed: Jul. 12, 1988

[30] Foreign Application Priority Data

Aug. 4, 1987 [IT] Italy ..... 83424 A/87

[51] Int. Cl.[5] ..... B65G 67/00

[52] U.S. Cl. ..... 414/339; 414/343; 414/353; 414/505; 414/520; 414/528; 104/2

[58] Field of Search ..... 414/339, 340, 345, 346, 414/528, 343, 352, 353, 502, 503, 505, 519, 520; 104/2, 7.3

[56] References Cited

U.S. PATENT DOCUMENTS

| | | | |
|---|---|---|---|
| 1,476,882 | 12/1923 | Forsyth | 414/339 X |
| 1,547,686 | 7/1925 | Rieff | 414/528 |
| 2,589,988 | 3/1952 | Bruno | 414/353 X |
| 3,107,804 | 10/1963 | Cox | 414/505 |
| 3,109,560 | 11/1963 | Rosenleaf | 414/505 X |
| 3,631,812 | 1/1972 | Winslow, Jr. | 414/520 X |
| 3,647,096 | 3/1972 | Holland | 414/528 |
| 3,842,994 | 10/1974 | Theurer et al. | 414/339 |
| 3,900,392 | 8/1975 | Speno et al. | 209/241 |
| 3,990,588 | 11/1976 | Dibben | 414/520 X |
| 4,479,439 | 10/1984 | Theurer et al. | 104/2 X |
| 4,576,538 | 3/1986 | Theurer et al. | 414/528 X |
| 4,760,796 | 8/1988 | Theurer et al. | 104/7.3 |
| 4,770,104 | 9/1988 | Theurer | 104/7.3 |
| 4,795,301 | 1/1989 | Snead et al. | 414/339 |
| 4,809,617 | 3/1989 | Theurer et al. | 414/528 X |
| 4,844,683 | 7/1989 | Compton | 414/520 |

FOREIGN PATENT DOCUMENTS

| | | | |
|---|---|---|---|
| 1021006 | 12/1957 | Fed. Rep. of Germany | 104/2 |
| 2403010 | 7/1975 | Fed. Rep. of Germany | 414/343 |
| 251366 | 11/1987 | Fed. Rep. of Germany | 104/2 |
| 2213862 | 11/1973 | France . | |
| 2252446 | 11/1974 | France . | |
| 2508950 | 5/1981 | France . | |
| 609622 | 3/1979 | Switzerland | 414/339 |

*Primary Examiner*—Robert J. Spar
*Assistant Examiner*—Robert S. Katz
*Attorney, Agent, or Firm*—Wegner & Bretschneider

[57] ABSTRACT

System to feed and discharge materials continuously for the rehabilitation of railway road beds and the like in cooperation with operational machines (21) coupled to a plurality of waggons (10) storing such materials, in which system each storage waggon (10) comprises:

hopper (11) to contain materials, with lower movable shutters (12) to open and close the hoppers (11), a lower conveyor (13) cooperating with the hoppers (11) and extending substantially along the whole length of the waggon (10) in a horizontal plane, a upper conveyor (14) extending substantially along the whole length of the waggon (10) in a horizontal plane, and an almost vertical conveyor (16) cooperating with the lower conveyor (13) in the transfer of materials.

16 Claims, 5 Drawing Sheets

Figure 1:
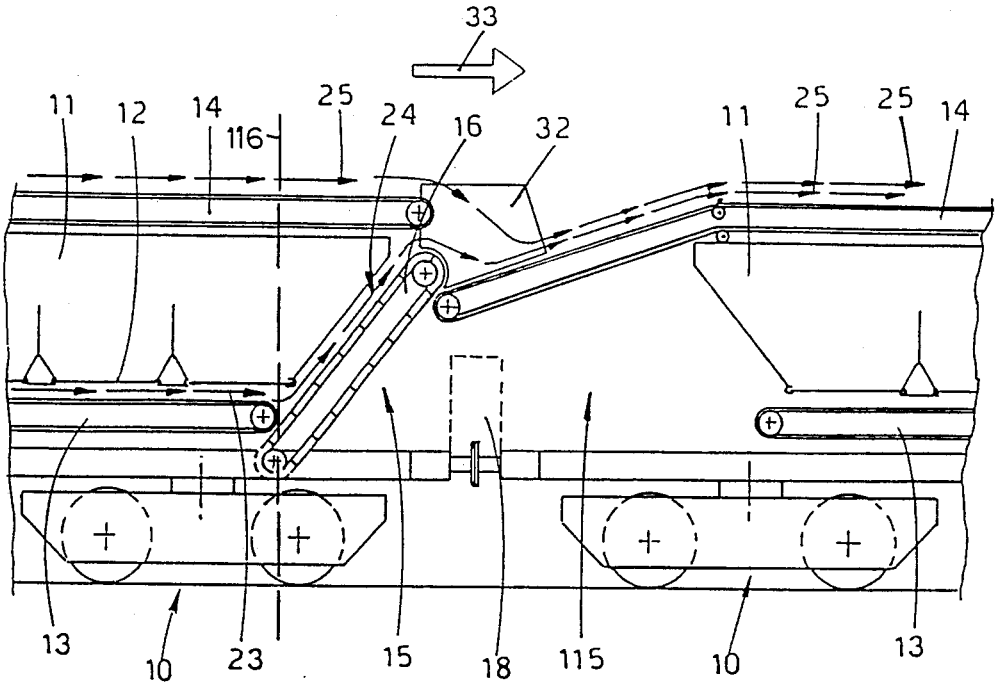

SYSTEM TO FEED AND DISCHARGE MATERIALS CONTINUOUSLY IN OPERATIONS TO REHABILITATE RAILWAY ROAD BEDS AND THE LIKE

This invention concerns a system to feed and discharge materials continuously in operations to rehabilitate railway road beds or like operations.

To be more exact, the invention concerns a system suitable to take materials from stores coupled to operational machines and to transfer and feed such materials to the operational machines.

The system is also suitable to transport and discharge continuously materials coming from the operational machines in cooperation with stores coupled to the operational machines or with other discharge means or systems.

In operations to form railway ballast or road beds, as also in operations to rehabilitate railway road beds, it is necessary to deliver to the operational machine either new ballast or, separately, new ballast and a mixture of aggregate materials, normally sand and gravel, depending on the type of operations to be performed.

In the same way the materials taken from the ballast or road bed and no longer usable in the condition in which they leave the operational machine have to be discharged somehow.

The productivity of the operational machines employed in the above work is very great and therefore the flow of materials being fed to and removed from such machines is very heavy.

In the prior art the feed of materials to the operational machines is carried out with storage containers borne on waggons coupled to the operational machines.

The storage containers are moved from their respective waggons to the feed zone of the operational machine, discharged there and then moved back to their respective positions on the waggons, where they remain until they have been re-filled in a loading station or with other means. The movement of the storage containers is normally carried out with portals which can be passed lengthwise between the support waggons and the operational machine.

This system to feed the operational machines is not continuous and therefore entails an unavoidable slowdown in the flow of feed and resulting limitations in the working capacity of the machines.

Moreover, these difficulties increase with an increase in the quantity of the feed materials which have to be kept as a stock for the operational machine.

In the prior art the materials which cannot be re-used and are discharged from the operational machines are normally placed in one or more appropriate waggons coupled to the machines or towed alongside the machines.

The known systems for such unusable materials discharged from the operationl machines provide for the inclusion of storage units for this purpose.

The present applicants have studied, tested and embodied a system for the continuous feed and discharge of materials which can overcome the problems of the art.

According to the invention a plurality of identical storage waggons bearing hoppers loaded with the materials required for the operations to be performed is coupled to the operational machine.

At least one conveyor to collect and carry the materials discharged from the hoppers is located below the hoppers and extends substantially along the whole length of each waggon in a horizontal plane.

A second conveyor to transfer materials is located above the hoppers and extends substantially along the whole length of each waggon in a horizontal plane.

The upper conveyors of each storage waggon are able to cooperate reciprocally and directly in the movement to materials from one waggon to another.

The lower conveyors cooperate terminally, in the common direction of feed of the upper and lower conveyors, with an almost vertical conveyor that transfers materials.

This almost vertical conveyor located at one end of each waggon cooperates with the upper conveyor of the successive waggon in the feed of materials towards the operational machine.

The method of working of the system is very simple. At the beginning of feeding, for instance starting from the waggon farthest from the operational machine, the required material is released from the corresponding hoppers onto the lower conveyor, is fed therealong until it is transferred onto the almost vertical conveyor of the same waggon and is carried by the latter conveyor onto the upper conveyor of the successive waggon.

Thence the material is passed in succession along the upper conveyors of each intervening waggon until it reaches the operational machine, where it is collected with suitable means.

Meanwhile, it is possible to release some of the material of the second waggon onto the lower conveyor of the same and, when the feed of material from the first waggon has ended or almost ended, that lower conveyor is actuated so as to continue the cycle in the same way.

The same storage waggons according to the invention can be employed to store the material discharged from the operational machine.

According to a variant the system will comprise only the lower conveyors cooperating on each waggon with the almost vertical conveyor.

Each almost vertical conveyor is associated with stationary means, chutes or the like for instance, which transfer the material onto the lower conveyor of the successive waggon.

In this case too the method of working is very simple.

At the beginning of feeding, starting from the storage waggon next to the operational machine for instance, the required material is released from the corresponding hoppers onto the lower conveyor, on which it is fed to the almost vertical conveyor,which delivers it to the operational machine.

At the same time the material is released onto the lower conveyor of the storage waggon next to the foregoing waggon and is fed therealong towards the relative almost vertical conveyor, which delivers the material through the stationary transfer means onto the lower conveyor of the first waggon, which has been gradually emptied of the material it contained.

The system proceeds in the same way up to the last storage waggon.

The storage waggons employed for discharge of unusable materials are equipped with upper conveyors in this embodiment too.

Each upper conveyor cooperates momentarily with associated means which discharge material from the upper conveyor into the hoppers of the corresponding storage waggon.

According to a variant, if the operational machine is a road bed rehabilitation machine, the same storage waggon will perform the feeding, discharge and storage of materials.

Each waggon will comprise an upper conveyor, lower conveyor, almost vertical conveyor and stationary means for transfer of materials. The almost vertical conveyor and stationary transfer means will be positioned at the opposite ends of each waggon.

The lower and almost vertical conveyors in cooperation with the stationary transfer means will feed the materials to the collection zone of the rehabilitation machine.

The upper conveyors move in the opposite direction to that of the feed and receive materials from the discharge zone of the rehabilitation machine, thereafter loading them into the waggons which are emptied of the feed materials.

The method of working may be as follows. Starting from the storage waggon farthest from the rehabilitation machine, the required material is released from the corresponding hoppers onto the lower conveyor and is fed therealong until it is transferred onto the almost vertical conveyor of the same waggon.

Thence the material is fed through the stationary transfer means of the next waggon onto the lower conveyor of that waggon, and so on in succession until it reaches the collection zone of the materials fed to the rehabilitation machine.

According to desired sequences the materials to be removed from the rehabilitation machine are transferred onto the upper conveyor of the waggon next to the machine and are despatched thence in the opposite direction to that of the feed materials by means of the upper conveyors of each waggon until they reach the storage waggon farthest from the machine.

The materials thus removed are unloaded into the hoppers of such farthest waggon, which have been previously emptied of the feed materials held in them.

The process continues until the storage waggon next to the rehabilitation machine has been filled.

In this variant all the storage waggons are coupled to one end of the rehabilitation machine and thus the other free end can be used to couple the machine to other operational machines, such as reinforcing, forming and other machines, so as to enable the condition of the line to be restored, even in short intervals between the passage of one train and another.

The almost vertical conveyors are fitted in such a way that they can be swung at an angle to the usual plane of feed of the material about a vertical axis.

In this way the materials can be discharged sideways from the storage waggon onto suitable transport means located alongside the waggon or in a place suitable for the purpose.

The invention is therefore obtained according to the content of claim 1 and of the dependent claims.

Figure 2:
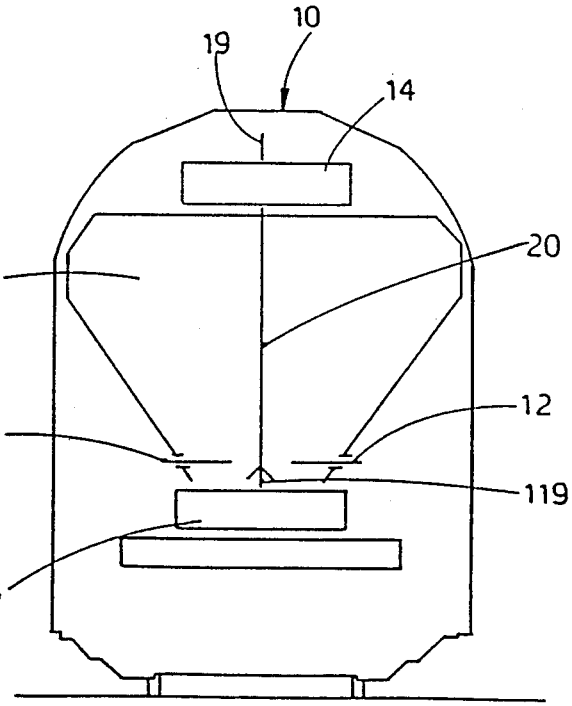
Figure 3:
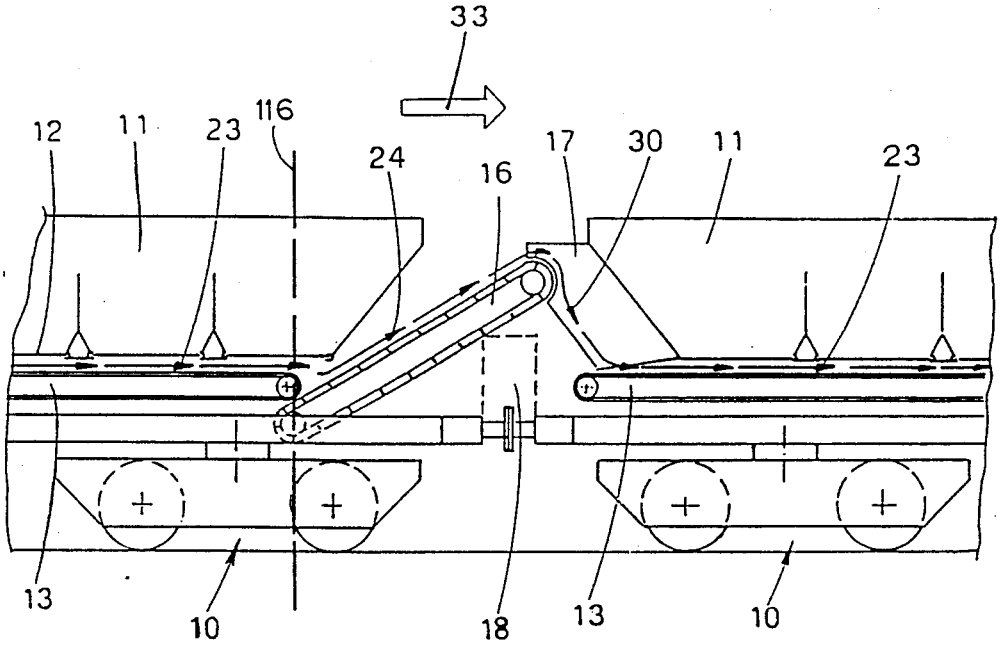
Figure 4:
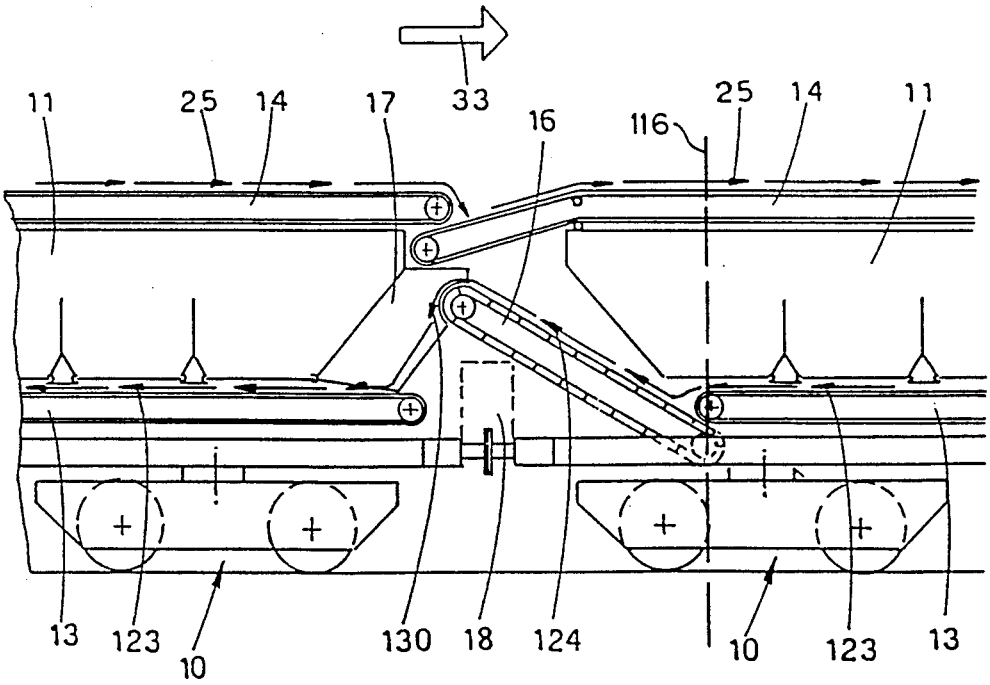
Figure 5:
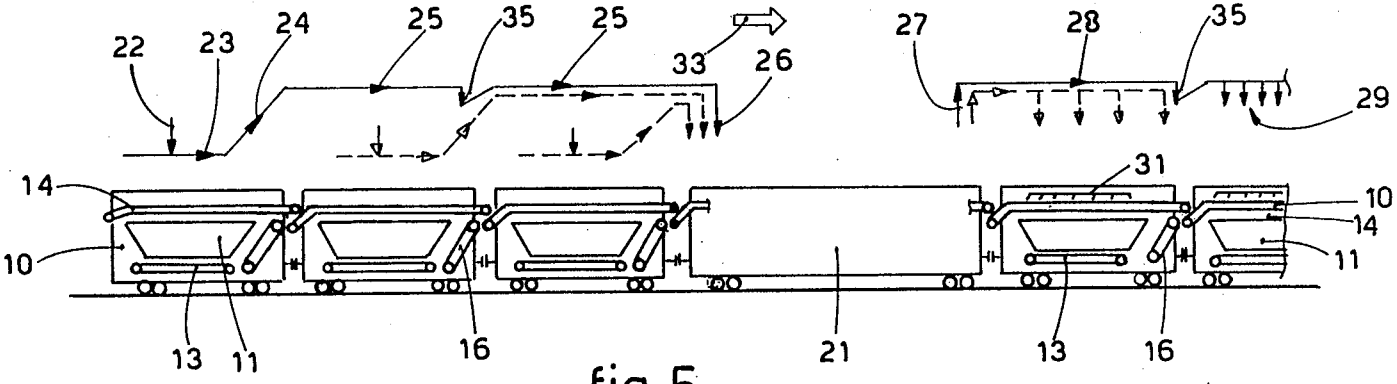
Figure 6:
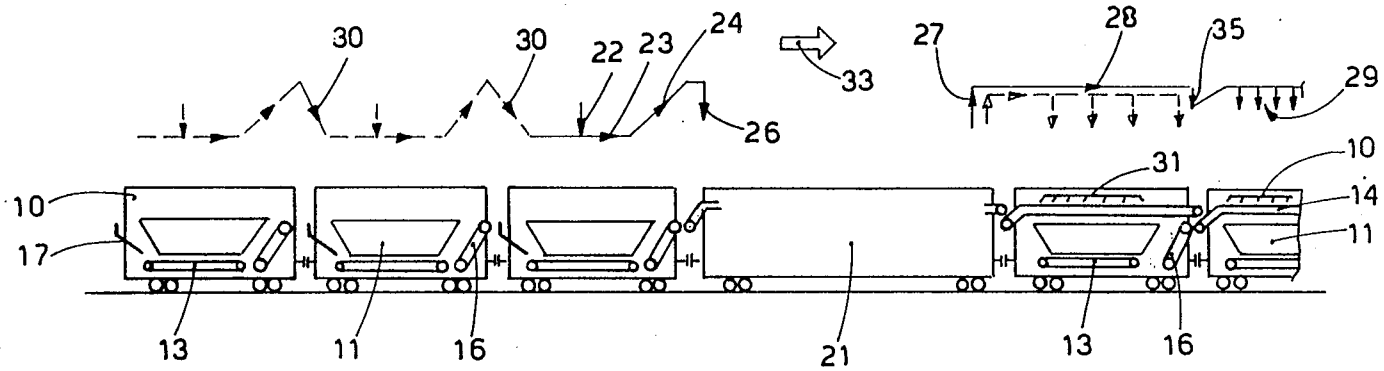
Figure 7:
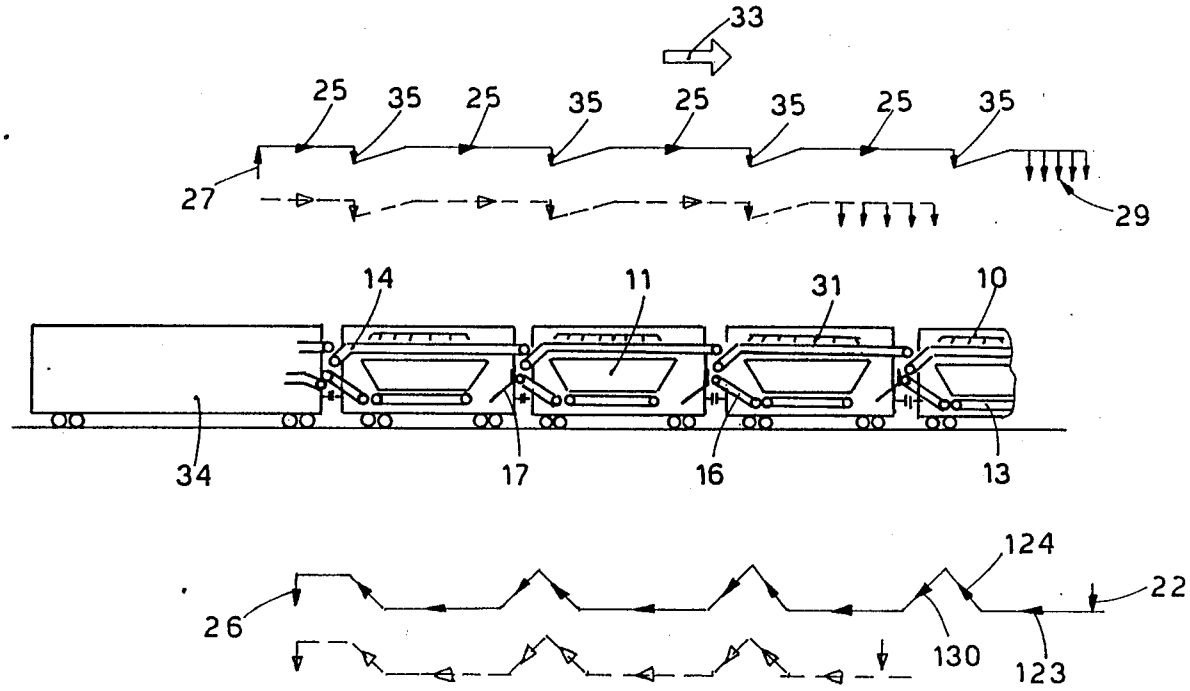
Figure 8:
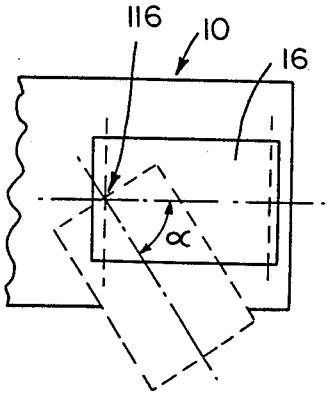

The attached figures, which are given as a non-restrictive example, show the following:

FIG. 1 gives a diagrammatic side view of an embodiment of the invention;

FIG. 2 gives a diagram of a cross section of a storage waggon according to the invention;

FIG. 3 gives a diagrammatic side view of a variant of the embodiment of FIG. 1;

FIG. 4 shows a diagrammatic side view of another variant of the embodiment of FIG. 1, as applied to a rehabilitation machine;

FIG. 5 gives a diagram of a cycle of feed and discharge of the operational machine according to the invention;

FIG. 6 gives a diagram of a cycle of feed and discharge of the operational machine according to a variant of the invention;

FIG. 7 shows diagrammatically a cycle of feed and discharge of a rehabilitation machine according to a variant;

FIG. 8 gives a diagrammatic top view of an embodiment of the invention; and

Figure 9:
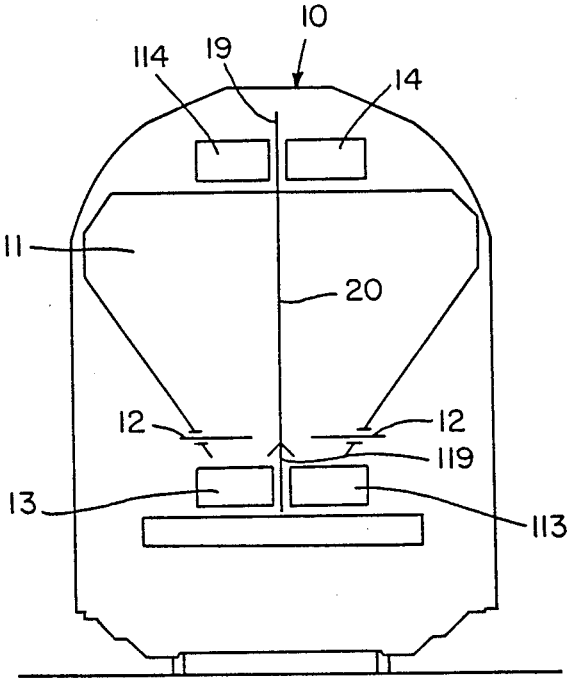

FIG. 9 gives a diagram of a cross-section of a storage waggon according to an embodiment of the invention.

The diagram of FIG. 1 shows two identical, neighbouring storage waggons 10. Each waggon 10 holds hoppers 11 to store materials.

The hoppers 11 cooperate on their lower side with movable shutters 12 which open and close the hoppers 11.

Lower 13 and upper 14 conveyors are comprised below and above the hoppers 11 respectively. If the storage waggons 10 feed metalling and aggregate to the operational machine, then the conveyors 13 and 14 are divided in two In one embodiment, each of conveyors 13 and 14 are divided in two by central partitions 119 and 19, respectively. This embodiment is clearly shown in FIG. 2. Alternatively, each of conveyors 13 and 14 may comprise two individual conveyors 13,113 and 14,114, respectively. This embodiment is clearly shown in FIG. 9.

In the same way the hoppers 11 will have differentiated storage compartments.

An almost vertical conveyor 16 is located at a terminal part 15 of each waggon 10 and cooperates at its lower end with the lower conveyor 13 and at its upper end with the upper conveyor 14 of the neighbouring waggon 10, such upper conveyor being located in a facing terminal part 115 of the neighbouring waggon 10.

Almost vertical conveyor 16 may be swingable about vertical axis 116 to an angle alpha, as shown in FIG. 8. This embodiment allows materials to be discharged at an angle from the storage waggon onto a suitable transport means located alongside the waggon.

A transfer hopper 32 is included to transfer materials directly from the upper conveyor 14 of each waggon 10 to the upper conveyor 14 of the neighbouring waggon 10.

FIG. 1 shows a service space 18 which has to be left free for inspection and handling work.

The direction of feed of the work train is marked with an arrow 33, whereas arrows 23, 24 and 25 show the direction of feed of the materials being fed to the operational machine, as shown later in FIG. 5.

FIG. 2 shows a diagrammatic cross section of the storage waggon 10 with the lower 13 and upper 14 conveyors embodied as being of a single type divided by partitions 19–119 so as to carry different materials. The hopper 11 too comprises a partition 20 for the same purpose.

FIG. 3 shows a variant of FIG. 1 in which means 17 to transfer materials, such as a chute, hopper or the like, cooperate with the almost vertical conveyor 16 and are able to transfer materials from the lower conveyor 13 of each waggon 10 to the lower conveyor 13 of the neighbouring waggon 10. Upper conveyors 14 are not comprised in this variant.

FIG. 4 shows another variant of the invention for use in cooperation with a road bed rehabilitation machine. Arrows 123,124 and 130 show that the direction of feed of materials to the rehabilitation machine is opposite to the direction of removal of materials 25 as shown later in FIG. 7.

FIG. 5 gives a diagram of a working train with storage waggons 10 to feed materials to and remove materials from an operational machine referenced generically with 21.

The working cycle is shown with flow lines drawn above the working train. As an example, the cycle begins with discharge of the hopper 11 onto the lower conveyor 13 of the storage waggon 10 farthest from the operational machine 21, as indicated by the arrow 22 on the continuous line.

The arrows 23 and 24 on the same line indicate the feed of material on the lower conveyor 13 and the elevation and transfer of the material on the almost vertical conveyor 16 respectively.

The arrows 25 indicate the feed of the same material on the upper conveyors 14 of the neighbouring waggons 10 in cooperation with transfer hoppers 32 on each waggon 10, as shown by the arrow 35.

The arrow 26 indicates discharge of material in the feed zone of the operational machine 21.

In the same way, the lines of dashes show the flow of material when the hopper 11 of the first waggon 10 has been emptied.

The arrow 27 shows the removal of material from the operational machine 21, the arrow 28 shows the movement of such removed material on the upper conveyors 14 and the arrows 29 indicate the discharge of the material into the hopper 11, for instance, of the waggon 10 farthest from the operational machine 21.

The lines of dashes of the removal indicate the final loading of the hopper 11 of the waggon 10 nearest to the operational machine 21.

FIG. 5 shows movable discharge means 31 cooperating momentarily with the upper conveyors 14 of the waggons 10 receiving the removed materials so as to discharge such materials into the hoppers 11.

FIG. 6 shows, analogously to FIG. 5, the working cycle according to a variant of the invention in which the upper conveyors 14 are not included in the waggons 10 feeding the materials.

As an example, the cycle begins with the waggon 10 nearest to the operational machine and passes on in succession to the discharge of the hoppers 11 in the waggons 10 farthest from the machine.

Arrows 30 indicate the transfer of material from the almost vertical conveyors 16 to the lower conveyors 13 through the transfer means 17.

FIG. 7 shows diagrammatically, according to a variant, a working train connected to a rehabilitation machine.

The lower part of the diagram indicates the flow of materials transferred by the lower conveyors 13, whereas the upper part indicates the analogous flow for the upper conveyors 14.

For the sake of simplicity we have indicated the flows for the waggon 10 farthest from the rehabilitation machine 34 and for the waggon 31 next to that waggon 10, the other flows being wholly analogous.

I claim:

1. System to feed and discharge materials continuously for the rehabilitation of railway road beds and the like in cooperation with at least one operational machine, wherein the system comprises a plurality of waggons for storing materials and wherein each waggon comprises:

at least one hopper adapted to contain materials and comprising lower movable shutter means for opening and closing said at least one hopper;

a lower conveyance means for conveying material, said lower conveyance means cooperating with said at least one hopper and extending substantially along the whole length of the waggon in a horizontal plane;

an upper conveyance means for conveying material, said upper conveyance means being disposed above said at least one hopper and extending substantially along the whole length of the waggon in a horizontal plane; and an almost vertical conveyance means for conveying material, said almost vertical conveyance means cooperating with the lower conveyance means in the tranfer of materials.

2. System as claimed in claim 1, wherein said almost vertical conveyance means of a first said waggon is adapted to cooperate with the upper conveyance means of a second said waggon longitudinally coupled thereto.

3. System as claimed in claim 1, wherein said upper conveyance means of said waggon is adapted to cooperate with the upper conveyance means of at least one additional said waggon longitudinally coupled thereto.

4. System as claimed in claim 1, wherein said plurality of waggons are adapted to selectively feed materials to and remove materials from the operational machine.

5. System as claimed in claim 1, wherein said at least one hopper is provided with longitudinal partition means for separating different stored materials.

6. System as claimed in claim 1, wherein each of said upper conveyance means and said lower conveyance means comprises a single conveyor.

7. System as claimed in claim 1, wherein each of said upper conveyance means and said lower conveyance means comprises two conveyors.

8. System as claimed in claim 1, wherein each said waggon comprises transfer means for transferring material, said transfer means cooperating with said almost vertical conveyance means of a first said waggon and said lower conveyance means of a second said waggon longitudinally coupled thereto.

9. System as claimed in claim 1, wherein each said waggon further comprises discharge means for discharging material into said at least one hopper, said discharge means being adapted to momentarily cooperate with said upper conveyance means.

10. System as claimed in claim 1, wherein said upper conveyance means moves material in a first direction for the removal and storage of material from the operational machine, wherein said lower conveyance means moves material in a second direction for the feed of material towards the operational machine, and wherein said first direction and said second direction are opposite.

11. System as claimed in claim 10, wherein the operational machine is a road bed rehabilitation machine.

12. System as claimed in claim 11, wherein said plurality of waggon are longitudinally coupled and wherein said rehabilitation machine is longitudinally coupled to only one said waggon.

13. System as claimed in claim 1, wherein the operational machine is a road bed rehabilitation machine.

14. System as claimed in claim 13, wherein said plurality of waggons are longitudinally coupled and wherein said rehabilitation machine is longitudinally coupled to only one said waggon.

15. System as claimed in claim 1, wherein said almost vertical conveyance means is swingable about a vertical axis at an angle to the longitudinal direction of said waggon.

16. System as claimed in claim 1, wherein each said wagon further comprises partition means for longitudinally partitioning each of said upper conveyance means and said lower conveyance means.

* * * * *